United States Patent [19]

Umemura et al.

[11] Patent Number: 4,784,191

[45] Date of Patent: Nov. 15, 1988

[54] DEVICE FOR STORING A WEFT YARN FOR INSERTING IN A JET LOOM

[75] Inventors: Yoshifumi Umemura, Toyoake; Yutaka Sato, Kariya; Kinpei Mitsuya, Aichi; Noboru Kobayashi, Anjo; Kazuhiko Okubo, Kariya; Masahiko Kako, Nagoya, all of Japan

[73] Assignee: Kabushiki Kaisha Toyoda Jidoshokki Seisakusho, Kariya, Japan

[21] Appl. No.: 810,400

[22] Filed: Dec. 18, 1985

[30] Foreign Application Priority Data

| | | | |
|---|---|---|---|
| Dec. 22, 1984 | [JP] | Japan | 59-271618 |
| Dec. 28, 1984 | [JP] | Japan | 59-199588[U] |
| Jan. 11, 1985 | [JP] | Japan | 60-2606[U] |
| Jan. 11, 1985 | [JP] | Japan | 60-2605[U] |
| Jan. 21, 1985 | [JP] | Japan | 60-6464[U] |
| Jan. 25, 1985 | [JP] | Japan | 60-9379[U] |

[51] Int. Cl.[4] ..... D03D 47/34

[52] U.S. Cl. ..... 139/452; 226/119

[58] Field of Search ..... 139/452; 226/7, 118, 226/119

[56] References Cited

U.S. PATENT DOCUMENTS

| | | | |
|---|---|---|---|
| 3,712,526 | 1/1973 | Hanousek et al. | 139/452 |
| 3,967,654 | 7/1976 | Muller | 139/452 |
| 4,436,123 | 3/1984 | Senn et al. | 139/452 |

FOREIGN PATENT DOCUMENTS

| | | | |
|---|---|---|---|
| 36509 | 10/1971 | Japan | 139/452 |
| 27218 | 8/1973 | Japan | 139/452 |
| 26097 | 7/1974 | Japan | 139/452 |

*Primary Examiner*—Henry S. Jaudon

*Attorney, Agent, or Firm*—Brooks Haidt Haffner & Delahunty

[57] ABSTRACT

A device for storing a weft yarn for inserting in a jet loom, which is provided with a weft yarn retaining surface, is movable relative to a feed nozzle, for receiving a weft yarn ejected from the feed nozzle. The device is characterized in that a blacking member is arranged in such a manner that one end of the member is engaged with the weft yarn retaining surface at a depositing zone adjacent to the feed nozzle so as to block the fluid from the nozzle as would otherwise disturb the yarn deposited on the retaining surface. A gap is formed between the weft yarn retaining surface and the cover, which gap increases as a position moves away from the depositing zone towards the side where the stored weft yarn is withdrawn.

15 Claims, 13 Drawing Sheets

FIG. 7
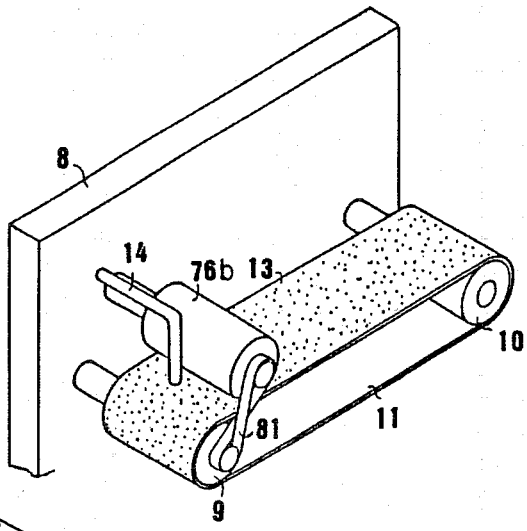
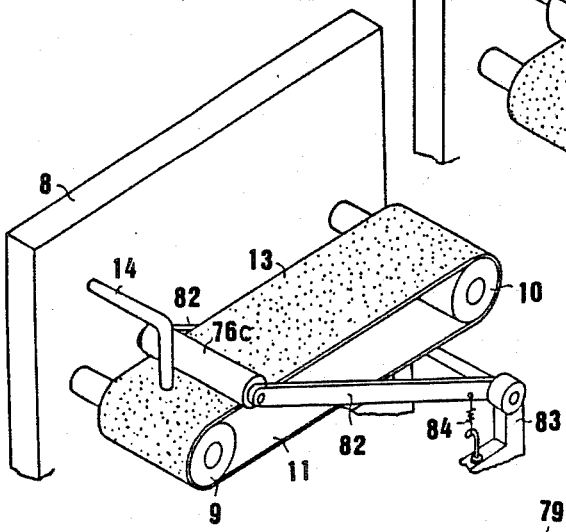
FIG. 8
FIG. 9
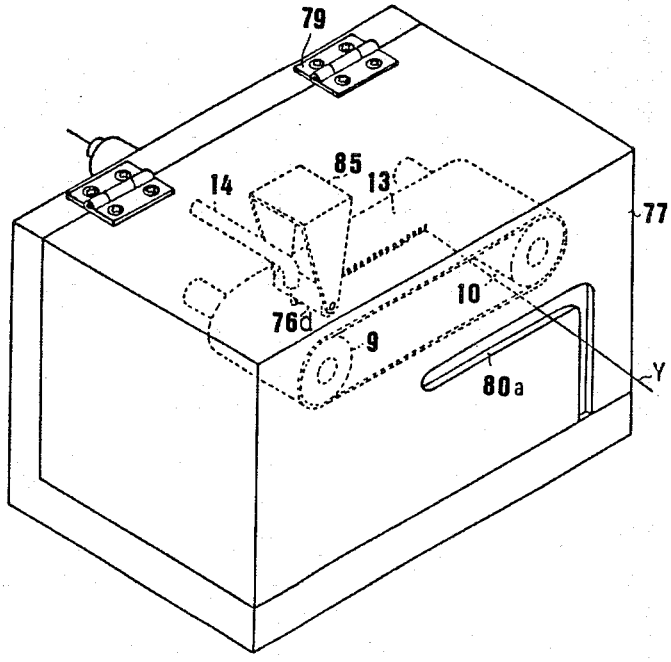

FIG. 22
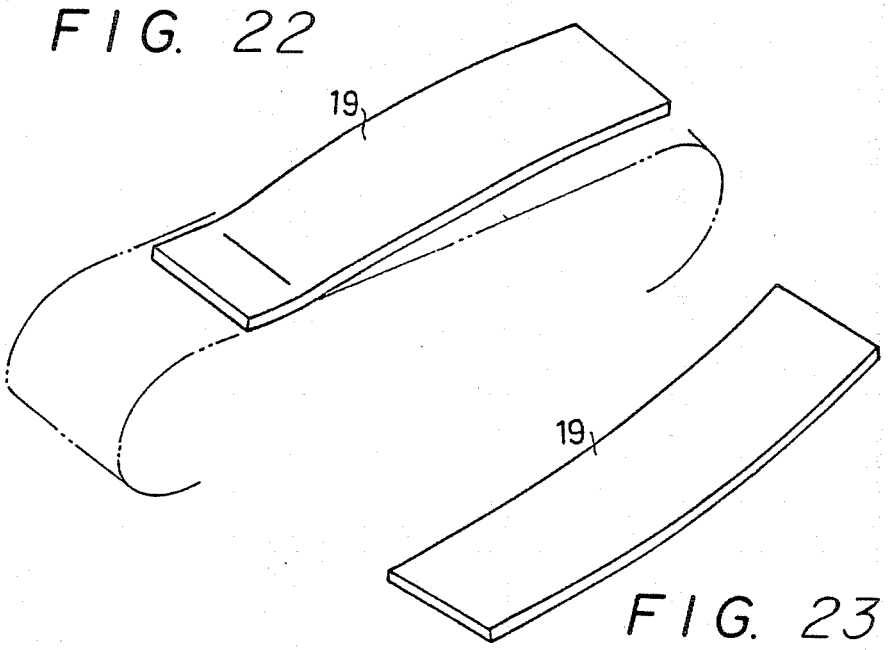
FIG. 23
FIG. 24
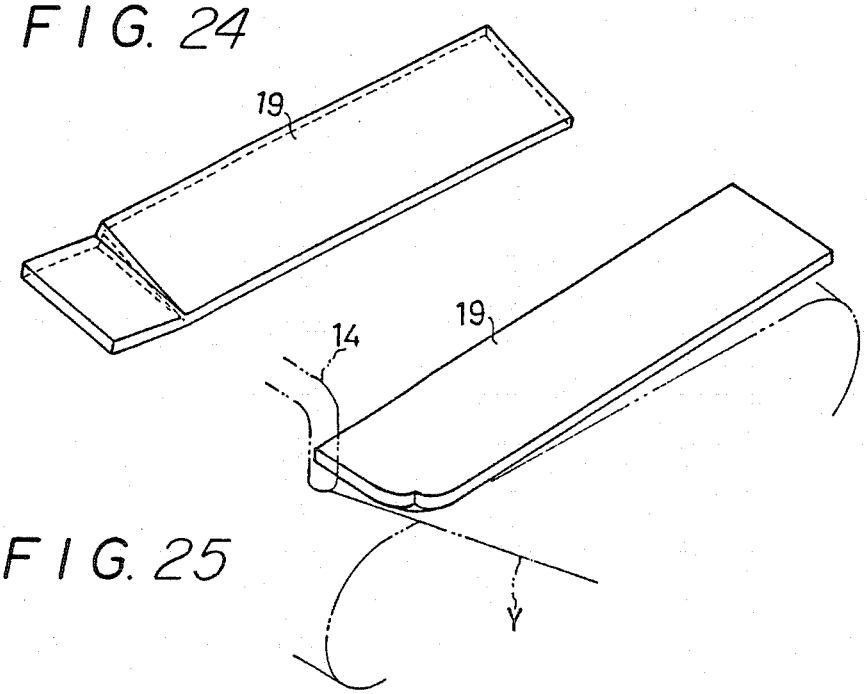
FIG. 25

FIG. 26
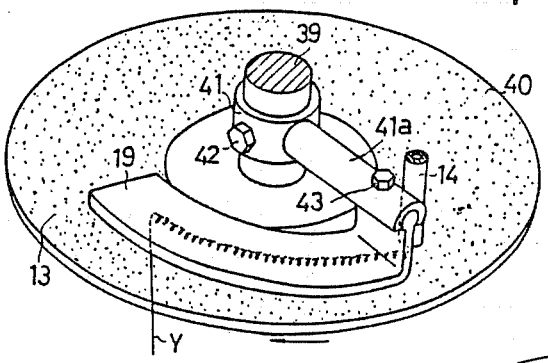
FIG. 27
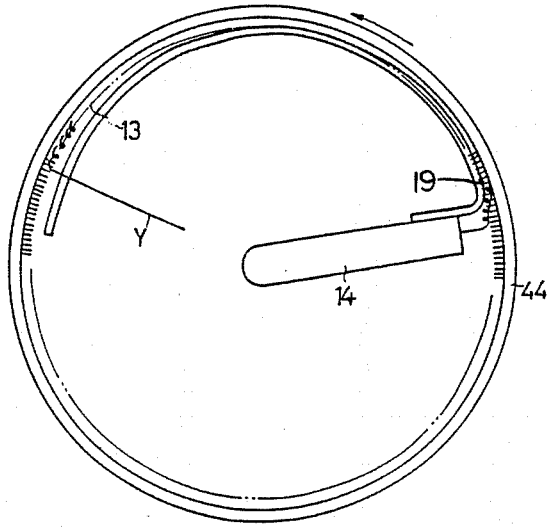
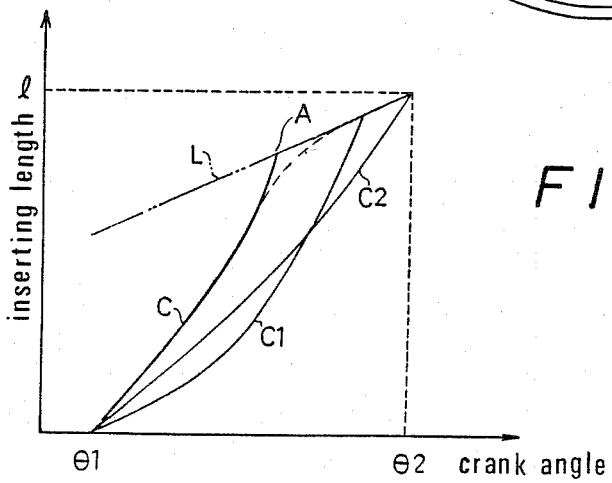
FIG. 28

DEVICE FOR STORING A WEFT YARN FOR INSERTING IN A JET LOOM

TECHNICAL FIELD OF THE INVENTION

The present invention relates to a device for storing a weft yarn for inserting in a jet loom comprising a surface, which moves in one direction and retains a weft yarn thereon, and a feed nozzle, which ejects the weft yarn together with a fluid, such as air, onto the weft yarn retaining surface.

PRIOR ART

In a jet loom, a predetermined amount of weft yarn, fed from a weft yarn supply, is required to be measured and stored at every weft inserting operation. Conventionally the following devices have been generally used as weft yarn storing devices:

an air pool type storing device, wherein a weft yarn is continuously measured by a measuring roller or rollers and is ejected into and stored by a storing pipe; and a drum pool type storing device, wherein a weft yarn is wrapped around a drum to measure and store the weft yarn.

However, in the former device, i.e., the air pool type weft yarn storing device, since the weft yarn is stored in a U-shaped loop along the inside of the storing pipe by way of air, the weft yarn resists the air flow ejected from the feed nozzle when it is withdrawn as the weft inserting operation takes place. Accordingly, a large resistance occurs upon withdrawal of a stored weft yarn, which resistance will be referred to as "withdrawal resistance" hereinafter.

Further, since the withdrawal resistance is the largest at the time when the stored weft yarn starts to be withdrawn from the storing pipe, the tension in the weft yarn varies considerably. The variation in the weft tension may easily result in flight faults of a weft yarn, which is ejected from a weft yarn inserting main nozzle into a weft yarn guide passage formed by a plurality of weft yarn guides disposed on a slay. Accordingly, the weft yarn may escape during the inserting operation from the slit which is designed to allow the weft yarn to slip out from the weft yarn guide passage before being beaten up, or the weft yarn may form a loop within the weft yarn guide passage and may cause a faulty picking. Therefore, there may occur problems such that the quality of the woven fabric is degraded.

Furthermore, since the resistance is large when a weft yarn is withdrawn from the storing pipe, it is necessary to enhance the pressure of air ejected from the weft yarn inserting main nozzle so as to increase the propelling force of the weft yarn. As a result, there may occur other problems, for example, that the compressed air consumption is increased, or that the weft yarn is broken in the weft yarn inserting main nozzle if its strength is not large.

Contrary to this, in the latter weft yarn storing device, i.e., the drum pool type weft yarn storing device, ballooning may occur during the unwinding of the weft yarn from the drum. Accordingly, the withdrawal resistance of a weft yarn may become large.

In order to eliminate the problems, it is necessary when using the drum pool type weft yarn storing device, as well as the above-mentioned air pool type weft yarn storing device, to enhance the pressure of air ejected from the weft yarn inserting main nozzle so as to increase the propelling force of the weft yarn. As a result, there may occur similar problems, such as the increased compressed air consumption or the weft yarn breakage.

U.S. Pat. No. 4,436,123 discloses an example of a weft yarn storing device, which is intended to obviate the above-described problems.

In this conventional device, a weft yarn is ejected from a feed nozzle onto an endless belt extending between a drive roller and a driven roller and is retained in a coil-like shape on the endless belt. A cover plate rests on the entire weft yarn retaining surface of the belt. The weft yarn is deposited on the belt and is led to a portion below the plate together with the movement of the belt, and it is stored there until commencement of the weft inserting operation while it is subjected to pressing by the weight of the plate.

As a result, the weft yarn storing conditions on the weft yarn retaining surface are protected by the plate from being adversely affected by external influences, such as flying flies, and there is no throwing of turns of stored weft yarn upon its withdrawal.

It is necessary for the weft yarn to be appropriately deposited and stored on the weft yarn retaining surface so as to be withdrawn in good order from the weft retaining surface. In order to securely attach the weft yarn ejected from a feed nozzle to the weft yarn retaining surface, the pressure of the fluid (air) ejected from the feed nozzle must be set at a considerably high level. However, if fluid having such a high pressure collides with the weft yarn retaining surface, it is scattered there. Accordingly, the weft yarn, which has been deposited and stored on the weft retaining surface, is disordered. As a result, withdrawal of such a disordered weft yarn cannot be performed in good order, and there may be a problem that turns of weft yarn are thrown together.

In order to eliminate such a problem, the inventors of the present invention tried to enhance the moving speed of the belt so that the deposited weft yarn is promptly moved away from the region affected by the ejected fluid. However, the density of the stored weft yarn on the weft yarn retaining surface is decreased in this method, and accordingly, an increase of the storing area is necessary, and the enlargement of the mechanism and the increase of the power consumption are unavoidable.

In order to maintain the above-described storing conditions, the retaining surface of the above-described conventional device has to be made of, for example, moquette or raised woven fabric, so that it effectively retains the weft yarn ejected thereonto. Since the entire stored weft yarn is pressed against the retaining surface by the weight of the plate and is withdrawn in a horizontal direction from a portion between the belt and the plate, it is impossible to avoid an increase of the withdrawal resistance of the weft yarn upon the inserting operation regardless of the weight of the plate. Accordingly, the above-described conventional device cannot fully eliminate the problems of the enhancement of the pressure of air ejected from the weft yarn inserting main nozzle, which are inherent to the conventional air pool type or drum pool type weft yarn storing devices as described above and which result in the weft yarn breakage or the increased compressed air consumption.

Further, in this conventional device, the weft yarn retaining surface is formed by moquette or raised woven fabric, or a suction means is disposed at the back surface of the gas pervious member so as to suck the weft yarn onto the pervious member. Thus, floating flies are readily deposited onto the weft yarn retaining surface. As a result, the weft yarn may be easily contaminated with flies deposited on the weft yarn retaining surface, and when it is brought into a weft yarn inserting main nozzle from the weft yarn retaining surface, the flies may cause clogging of the nozzle, or the flies may be woven in the woven fabric and cause defects in woven fabric. The above-described United States Patent discloses an embodiment wherein a plate is rested on the weft yarn retaining surface so as to prevent external effects, such as deposition of floating flies, and wherein air is ejected to the weft yarn retaining surface so as to prevent the floating flies from depositing thereon. However, this embodiment is unpreferable because the construction may be complicated.

Furthermore, since the stored weft yarn is entirely subjected to the weight of the plate, the withdrawal resistance is almost constant from the commencement to the completion of the withdrawal from the retaining surface, and thereafter, the withdrawal resistance is suddenly changed when the weft yarn is directly fed from the feed nozzle to the inserting main nozzle just after all the stored weft yarn has been exhausted, even if the withdrawal resistance can be remarkably reduced. As a reaction to the sudden change in the resistance, the front end of the inserting weft yarn may escape through the slit of the weft yarn guides.

OBJECT OF THE INVENTION

An object of the present invention is to provide a device for storing a weft yarn for inserting in a jet loom, which can obviate the problems inherent to the conventional devices. More specifically, an object of the present invention is to achieve unexpected advantages in that it can appropriately store the weft yarn on the weft yarn retaining surface and in that it can prevent a weft yarn breakage or a faulty picking from occurring. According to one aspect of the present invention, a weft yarn stored on a weft yarn retaining surface is mainly protected from the influence of air ejected from a feed nozzle. According to another aspect of the present invention, an appropriate withdrawal resistance is applied to the weft yarn while it is withdrawn from the weft yarn storing device.

SUMMARY OF THE INVENTION

According to the first aspect of the present invention, a device for storing a weft yarn for inserting in a jet loom is provided. The device comprises a surface, which moves in one direction and retains a weft yarn thereon, and a feed nozzle, which ejects the weft yarn together with a fluid, such as air, onto the weft yarn retaining surface, the fluid ejected from the feed nozzle impingement upon the weft yarn retaining surface at a an impingement point. The device further comprises a means for blocking or deflecting the ejected fluid which is disposed at a position slightly displaced from the impingement point towards a start position where the weft yarn withdrawal operation is started.

The blocking means may be a plate extending transverse to the moving direction of the weft yarn retaining surface, and a lower end of the plate may be slightly spaced from or may be pressed to the weft yarn retaining surface. The lower end of the plate may be curved toward or away from the fluid impingement point. The lower front edge of said plate may be formed in an arc seen in said moving direction of said weft yarn retaining surface. The plate may have a plurality of holes penetrating and upwardly directed from one side facing the impingement point to the other side facing towards the start point.

The fluid blocking means may be a roller extending transverse to the moving direction of the weft yarn retaining surface, and the roller may be pressed against the weft yarn retaining surface.

The weft yarn retaining surface and the fluid blocking means may be contained in a container comprising a container body and a cover pivoted to the container body, at least one of either the cover or the container body having a withdrawal opening formed therein for guiding the weft yarn withdrawn from the weft yarn retaining surface, which withdrawal opening may be communicated with the outside at a free end of the cover.

According to the other aspect of the present invention, a device for storing a weft yarn for inserting in a jet loom is provided. The device comprises a surface, which moves in one direction and retains a weft yarn thereon, and a feed nozzle, which ejects the weft yarn onto the weft yarn retaining surface, the fluid ejected from the feed nozzle striking the weft yarn retaining surface at an impingement point. The device further comprises a withdrawal resistance applying means which engages the weft yarn during at least a part of the inserting operation.

The withdrawal resistance applying means may be a guide bar extending in the moving direction of the weft yarn retaining surface and engaging the weft yarn while the weft yarn is withdrawn. The guide bar may be pressed against the weft yarn retaining surface at a position laterally away from a weft yarn retaining zone on the weft yarn retaining surface. An end of the guide bar, near the fluid impingement point, may be bent transverse to the weft yarn retaining surface, and the bent portion may be pressed against the weft yarn retaining surface.

The weft yarn retaining surface and the resistance applying means may be contained in a container comprising a container body and a cover, at least one of either the cover or the container body having a withdrawal opening formed therein for guiding the weft yarn withdrawn from the weft yarn retaining surface, which withdrawal resistance applying means may be formed at the withdrawal opening. In this case, it is preferable that the withdrawal opening be formed as an elongated hole, and the withdrawal resistance applying means be a guide bar extending along the elongated hole.

The withdrawal resistance applying means may be constructed with a flexible belt pressed against the weft yarn retaining surface at a position laterally away from a weft yarn retaining zone on the weft yarn retaining surface and movable in the moving direction of the weft yarn retaining surface.

The withdrawal resistance applying means may be a plate extending over the weft yarn retaining surface and inclined in such a manner that a front edge thereof is pressed against the weft yarn retaining surface at a position away from a weft yarn retaining zone on the weft yarn retaining surface.

Alternatively, the withdrawal resistance applying means may be a cover member, one end of which is engaged with the weft yarn retaining surface at a position adjacent to the feed nozzle, and a gap is formed between the weft yarn retaining surface and the cover member, which gap increases as a position moves away from the fluid impingement point towards a start point where the stored weft yarn is withdrawn. It is preferable that the cover member is transparent.

Further, the withdrawal resistance applying means may be a yarn guide for guiding the weft yarn withdrawn from the weft retaining surface, and the location of the yarn guide can be adjusted relative to the weft yarn retaining surface.

BRIEF DESCRIPTION OF THE DRAWINGS

The present invention will now be explained in detail with reference to the accompanying drawings, wherein:

FIG. 7 is a perspective view of another embodiment of the present invention;

FIG. 8 is a perspective view of a still other embodiment of the present invention;

FIG. 9 is a perspective view of an embodiment of the present invention;

FIGS. 20 through 25 are perspective views of cover members which are applicable to a belt type weft yarn storing device;

FIG. 26 is a perspective view of a disc type weft yarn storing device;

FIG. 27 is an elevation view of a cylinder type weft yarn storing device; and FIG. 28 is a diagram illustrating the weft yarn flying conditions in the embodiment illustrated in FIGS. 1 through 3 and in conventional air pool type and drum pool type weft yarn storing devices.

DETAILED DESCRIPTION OF THE INVENTION

Figure 1:
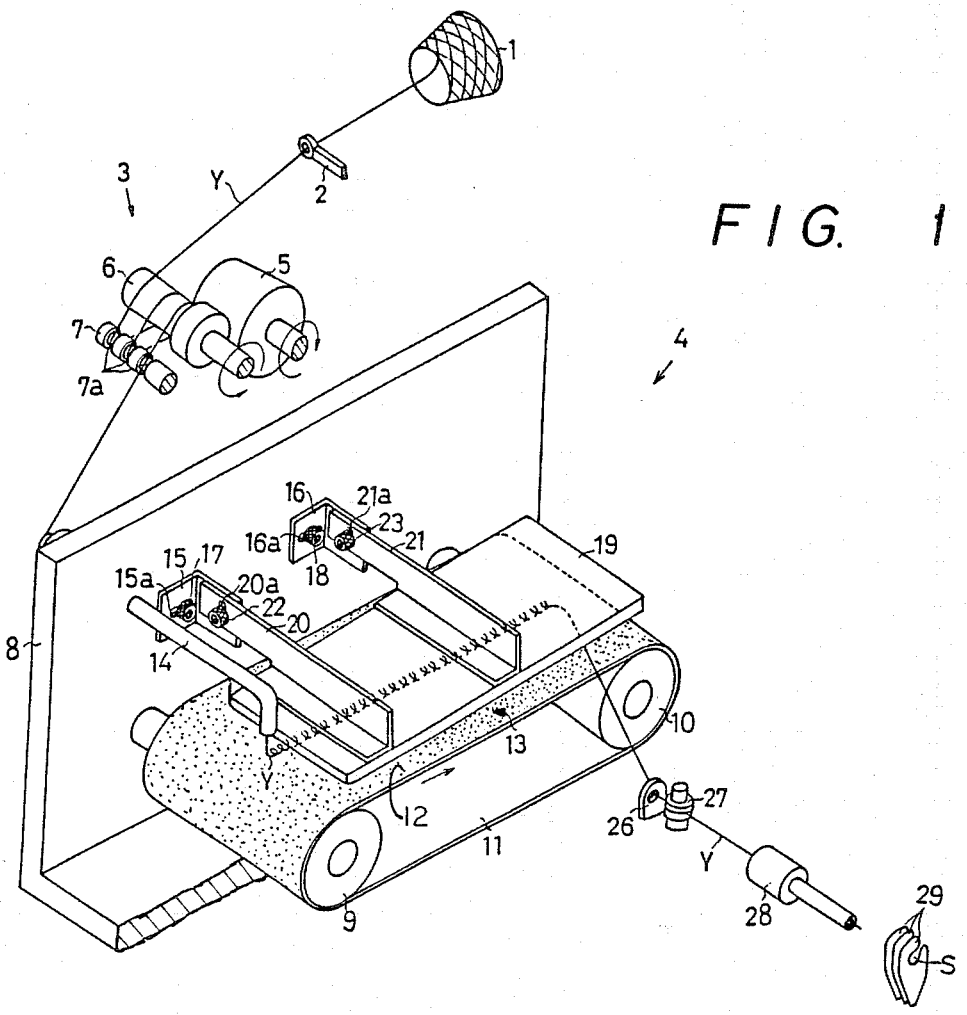
FIG. 1 is a perspective view of an embodiment of the present invention.

An embodiment of the present invention will now be explained with reference to FIGS. 1 and 2.

A weft yarn Y is supplied from a cheese 1 via a yarn guide 2 to a measuring roller mechanism 3, and it is continuously measured there.

The measuring roller mechanism 3 comprises a drive roller 5, which is continuously driven in synchronism with the rotation of the weaving loom, a driven roller 6, which is pressed to the drive roller 5 and is driven by the drive roller 5, and a guide bar 7, which is provided with guide grooves 7*a*. The weft yarn Y is wrapped around the driven roller 6 and the guide grooves 7*a*, and it is continuously withdrawn from the cheese 1 at a constant speed. Then, the weft yarn Y is introduced into a weft yarn storing device 4 due to the rotation of the drive roller 6.

The construction of the weft yarn storing device 4 will now be explained in detail. A drive roller 9 and a driven roller 10 are horizontally spaced a certain distance from each other and are supported by the front surface, i.e., the side facing the weft inserting mechanism, of a support frame 8. The support frame 8 is vertically fixed to a stationary mounting, such as a side frame of a weaving loom. The rollers 9 and 10 are driven at a predetermined speed by a drive mechanism (not shown).

An endless belt 11 is wrapped around the drive roller 9 and the driven roller 10 and has moquette 12 disposed on the outer surface thereof which, together with the rigidity of the belt 11, forms a weft yarn retaining surface 13. The drive roller 9 is driven in a clockwise direction in FIG. 2, and the upper side of the endless belt 11 is moved in a direction designated by an arrow in FIG. 2.

A feed nozzle 14 penetrates the support frame 8 in a direction parallel to the axis of the drive roller 9 at a position above the drive roller 9 and is supported by the support frame 8. The front end of the feed nozzle 14 is bent downwardly so that it is directed towards the weft yarn retaining surface 13 above the drive roller 9. The weft yarn Y is fed from the measuring roller mechanism 3 and is introduced into the feed nozzle 14, where it is continuously ejected together with a fluid, such as air, towards the weft yarn retaining surface 13.

A pair of support brackets 15 and 16 are shaped in a form of an angle and are adjustably secured to the front surface of the support frame 8 by means of screws 17 and 18. A cover member 19 formed as a flat plate has a pair of brackets 20 and 21 shaped in a form of an angle and secured to the upper surface thereof. The brackets 20 and 21 are adjustably secured to the support brackets 15 and 16 by means of screws 22 and 23 and nuts 24 and 25, so that the cover member 19 covers the weft yarn retaining surface 13. The left lower edge 19*a* of cover member 19 is founded, and provides a narrow fluid blocking means, for deflecting ejected fluid from the nozzle 14. The edge 19*a* is located near a fluid impingement position T, where the axis of the feed nozzle 14 intersects the weft yarn retaining surface 13, and is slightly displaced from the impingement position T toward the driven roller 10.

Figure 2:
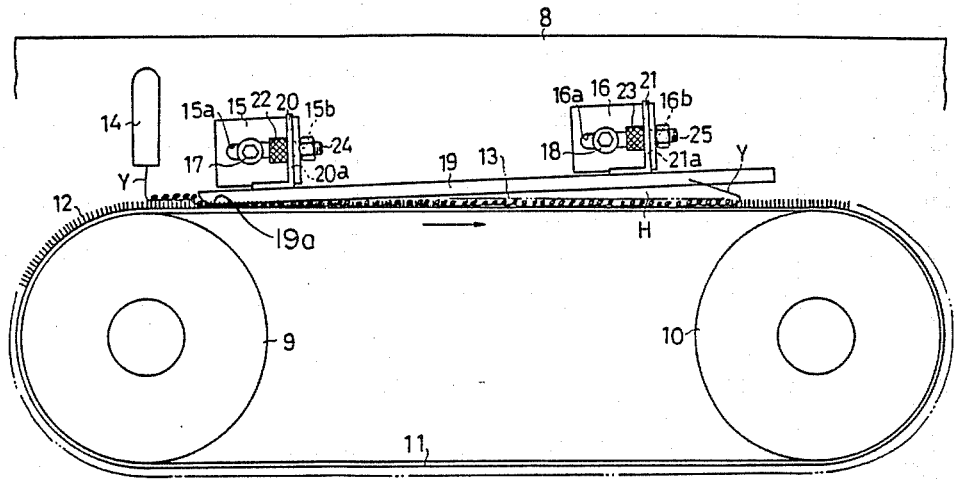
FIG. 2 is an elevation view of the essential parts of the embodiment illustrated in FIG. 1.
Figure 3:
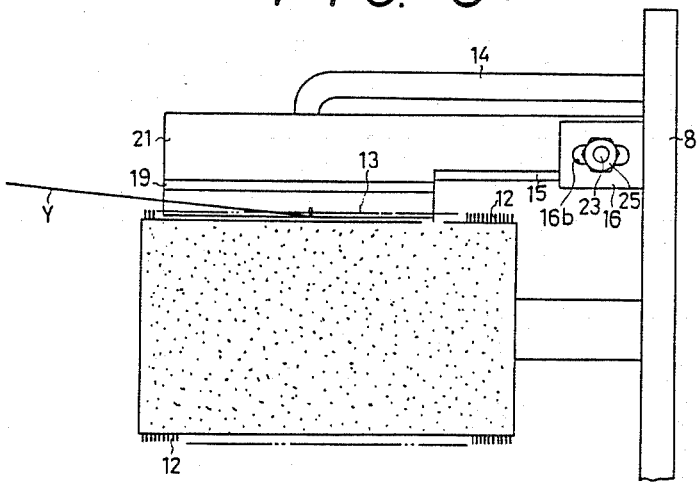
FIG. 3 is a side view of the essential parts of the embodiment of the present invention in FIG. 1.

In this embodiment, as illustrated in FIGS. 2 and 3, the left lower edge 19*a* of the cover member 19 is pressed onto the moquette 12 forming the weft yarn retaining surface 13 at a position near the feed nozzle 14, and the cover member 19 is inclined in such a manner that the cover member 19 is gradually away from the weft yarn retaining surface 13 as a position moves in a moving direction of the endless belt 11, i.e., in a direction designated by an arrow in FIG. 32, so that a narrow wedge shaped gap H is formed between the lower surface of the cover member 19 and the weft yarn retaining surface 13.

In front of the weft yarn storing device 4, there are disposed a yarn guide 26, a gripper 27, and a weft yarn inserting main nozzle 28. The gripper 27 and the main nozzle 28 are actuated in synchronism with the crank angle of the weaving loom to perform a weft yarn inserting operation.

The weft yarn Y ejected from the feed nozzle 14 is introduced into the weft yarn inserting main nozzle 28 via the yarn guide 26 and the gripper 27, and then, it is ejected into the weft yarn guide passage S formed by a plurality of weft yarn guides 29 mounted on a slay (not shown).

The weft yarn Y is ejected from the feed nozzle 14 at a predetermined speed on to the weft yarn retaining surface 13 located above the drive roller 9 and is deposited in a coil-like shape and attached to the weft yarn retaining surface 13. The weft yarn Y thus attached to the weft yarn retaining surface 13 is moved below the cover member 19 as the weft yarn retaining surface 13 moves. At this time, the weft yarn Y is so pressed to the weft yarn retaining surface 13 that it enters between the tufts of the moquette 12 by the pressing action between the lower surface 19*a* of the introducing end of cover member 19 and the moquette 12. As a result, the weft yarn Y is more evenly and securely attached to the weft yarn retaining surface 13 as compared to the attachment by only ejecting force from the feed nozzle 14. The weft yarn Y, which has been forcedly attached to the weft yarn retaining surface 13, is conveyed toward the driven roller 10 as the endless belt 11 moves, and it is stored on the weft yarn retaining surface 13 under the condition that it is covered by the cover member 19 until it is commenced to be inserted.

As the gripper 27 is actuated in accordance with the inserting timing program, the weft yarn inserting main nozzle 28 is operated, and the weft yarn Y, which has been stored on the weft yarn retaining surface 13 starts to be withdrawn from the portion which is located near the driven roller 10 and on the weft yarn retaining surface 13. As illustrated in FIG. 3, the stored weft yarn Y is withdrawn slightly upwardly in a direction substantially parallel to the weft yarn retaining surface 13. When the stored weft yarn Y, which is located inside the wedge shaped gap is withdrawn, the withdrawal resistance is not so large because the stored weft yarn Y is not pressed to the moquette 12 by means of the cover member 19. Accordingly, the weft yarn withdrawing speed can be increased without enhancing the ejecting pressure of the weft yarn inserting main nozzle 28, and weft yarn breakage in the weft yarn inserting main nozzle 28 can be prevented from occurring. Further, since the weft yarn can be evenly attached to the moquette 12 by means of the pressing action of the cover member 19, the stored weft yarn Y is successively withdrawn in good order regardless of the low withdrawal resistance. Accordingly, there is no danger that turns of the stored weft yarn Y are thrown together, and faulty picking can be prevented from occurring.

As the point of withdrawal of the stored weft yarn Y moves toward the feed nozzle 14 from the withdrawal start point, the height of the wedge shaped gap H converges to zero, and then such a condition occurs as that the stored weft yarn Y is pressed and held by the cover member 19 and moquette 12. The holding action is increased as the point of the withdrawal nears the weft yarn introducing end 19*a* of the cover member 19, and is the highest at the weft yarn entrance. In other words, the withdrawal resistance of the stored weft yarn Y increases as the withdrawing operation proceeds.

After the stored weft yarn Y is exhausted, the weft yarn Y is directly fed from the feed nozzle 14 and is inserted while its withdrawal is restrained by the feeding speed of the feed nozzle 14. Therefore, the weft yarn inserting speed is decreased upon transfer from the insertion by the withdrawal of the stored weft yarn Y to the above-described restrained weft yarn insertion. However, due to the gradual increase of the withdrawal resistance around the exhaust of the stored weft yarn, the sudden decrease of the weft inserting speed is relieved. Therefore, the disorder of the front end of the weft yarn due to the sudden decrease of the weft yarn inserting speed is prevented from occurring, and the front end of the weft yarn is also prevented from slipping out from the weft yarn guide passage S.

The front end of the weft yarn Y shows a flying line illustrated in a curve C in FIG. 28. The sign $\theta 1$ in FIG. 28 designates a crank angle of the weaving loom when the gripper 27 opens, and $\theta 2$ designates a crank angle of the weaving loom when the gripper 27 closes, l designates and inserting length which depends on the width of the woven fabric, and L designates an amount of the weft yarn fed from the measuring roller mechanism 3.

The point designated by A on the curve C corresponds to the time, when the stored weft yarn is exhausted by withdrawal and the condition is changed to that wherein the weft yarn is flown at a feeding speed of the measuring roller mechanism 3. According to the present invention, the weft yarn Y is gradually braked just before the transit from the insertion of the stored weft yarn by the restrained insertion as described above, and the weft yarn speed is gradually decreased as illustrated in a broken line.

Furthermore, the curve C1 shows a flying condition of the weft yarn fed from an air pool type weft yarn measuring device obtained at the same ejecting pressure as that for curve C, and the curve C2 shows a flying condition of the weft yarn fed from a drum pool type weft yarn measuring device obtained at the above-described condition.

As will be apparent from curves C, C1, and C2, it is shown in FIG. 28 that, in the weft yarn measuring device of the present invention, the withdrawal resistance of the weft yarn can be minimized while the weft yarn, which has been stored on the weft yarn retaining surface, is inserted. Further, as described above, the weft yarn is braked as it nears the condition A, and the weft yarn speed is gradually lowered. The increase of the tension in the weft yarn can be small at the moment when the inserting condition is changed to the restrained inserting condition. Accordingly, the device of this embodiment of the present invention can minimize problems, such as entanglement of the weft yarn in the weft yarn inserting main nozzle 28, or slipping of the weft yarn from the weft yarn passage S through the slits of the weft yarn guides.

According to the present embodiment, the cover member 19 prevents the weft yarn retaining surface 13 or the stored weft yarn from being attached to by fluffs and the weft yarn, which has already been deposited, from being disordered by air flow ejected from the feed nozzle 14. Furthermore, if the locational arrangements of the support brackets 15 and 16 and the brackets 20 and 21 are appropriately adjusted, the pressing condition between the weft yarn entrance of the cover member 19 and the moquette 12 can be set at an optimal condition in accordance with the kind and count of the weft yarn, and the shape of the wedge shaped gap H can also be adjusted as desired.

Incidentally, the fluid ejected from the feed nozzle 14 collides with the belt 11 and scatters in all directions along the belt surface 11. However, in this embodiment, the fluid scattered in the moving direction of the belt 11 is blacked by the blacking means provided by the front edge 19*a* of the cover member 19. Accordingly, the fluid ejected from the feed nozzle 14 does not adversely affect the weft yarn Y which has been deposited on the weft yarn retaining surface 13 and which has been conveyed toward the withdrawal starting position blacking. Therefore, there is no danger that the deposited condition of the stored weft yarn Y is disordered.

More specifically, due to the cooperation between the ejecting action of the feed nozzle 14 and pressing action of the lower end 19*a* of the cover member 19, the weft yarn is evenly deposited on the weft yarn retaining surface 13 and retained there. Thus, a preferable depositing condition is maintained until just before the commencement of the weft yarn insertion. Accordingly, the stored wefy yarn Y is withdrawn in good order from the weft yarn retaining surface 13 during the weft yarn inserting operation, and there is no danger of a faulty picking.

As described above, the fluid blacking means obviates the adverse effects of the fluid ejected from the feed nozzle 14 on the stored weft yarn Y, and therefore, there is no danger such as adverse effects of the ejected fluid on the stored weft yarn, even when the moving speed of the belt 11 is decreased. Accordingly, it is possible to enhance the density of the stored weft yarn by decreasing the moving speed of the belt 11. Therefore, the storing device can be compact. Due to the compact mechanism and the decrease of the moving speed of the belt 11, the power consumption can be reduced.

In the embodiment illustrated in FIGS. 1 and 2, the lower edge 19*a* of the blacking is pressed against the moquette 12 forming the weft yarn retraining surface 13. However, the effect of blacking the ejected fluid may be fully achieved even if the lower edge 19*a* of the blacking means is slightly spaced from the weft yarn retaining surface 13.

The present invention is not limited the above-described embodiment. Alternatives will be explained with reference to FIGS. 3 through 8.

Figure 4:
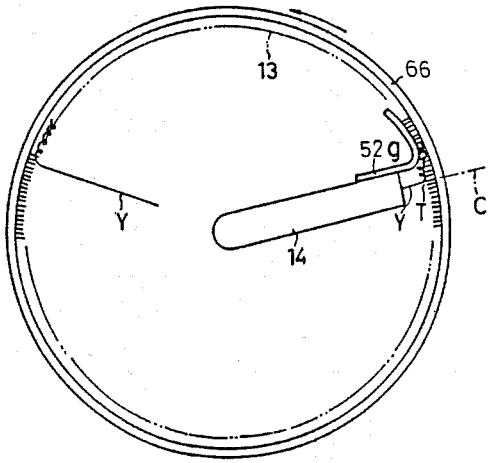
FIG. 4 is an elevation view of a cylinder type weft yarn storing device.

In the embodiment illustrated in FIG. 4, a weft yarn retaining surface 13 is formed on the inner surface of a rotating cylinder 66, and a weft yarn Y is ejected onto the weft yarn retaining surface 13 from a feed nozzle 14, which is disposed inside the cylinder 66. The feed nozzle 14 has fluid blacking means 52*g* secured thereto and formed in an arc.

Although in this embodiment, the cylinder 66 is rotated, the feed nozzle 14 and the blacking means 52*g* may be rotated about the axis of the cylinder 66 in place of the cylinder 66. Alternatively, the weft yarn retaining surface may be formed on the outer surface of the cylinder 66.

In the above-described embodiments, the ejecting direction of the feed nozzle 14 is set substantially perpendicular to the weft yarn retaining surface 13, however, the axis of the feed nozzle 14 may be inclined with respect to the weft yarn retaining surface as long as the weft yarn is not prevented from depositing onto the weft yarn retaining surface 13.

According to the above-described embodiments of the present invention, a weft yarn ejected from a feed nozzle is deposited onto a weft yarn retaining surface in a coil-like shape, and the deposited weft yarn is led to a portion between the weft yarn retaining surface and the means for blacking the ejected air as the weft yarn retaining surface 13 moves. The fluid (air) ejected from the feed nozzle collides with the weft yarn retaining surface and is scattered. However, the ejected fluid (air) is prevented from scattering toward the portion, where the weft yarn is withdrawn, by means of the ejected fluid blacking means. Accordingly, the weft yarn, which has been deposited and stored on the weft retaining surface, is prevented from being disordered. As a result, turns of weft yarn are not thrown together, and the withdrawal of the stored weft yarn can be effected in good order.

Other embodiments of the present invention will now be explained.

Figure 5:
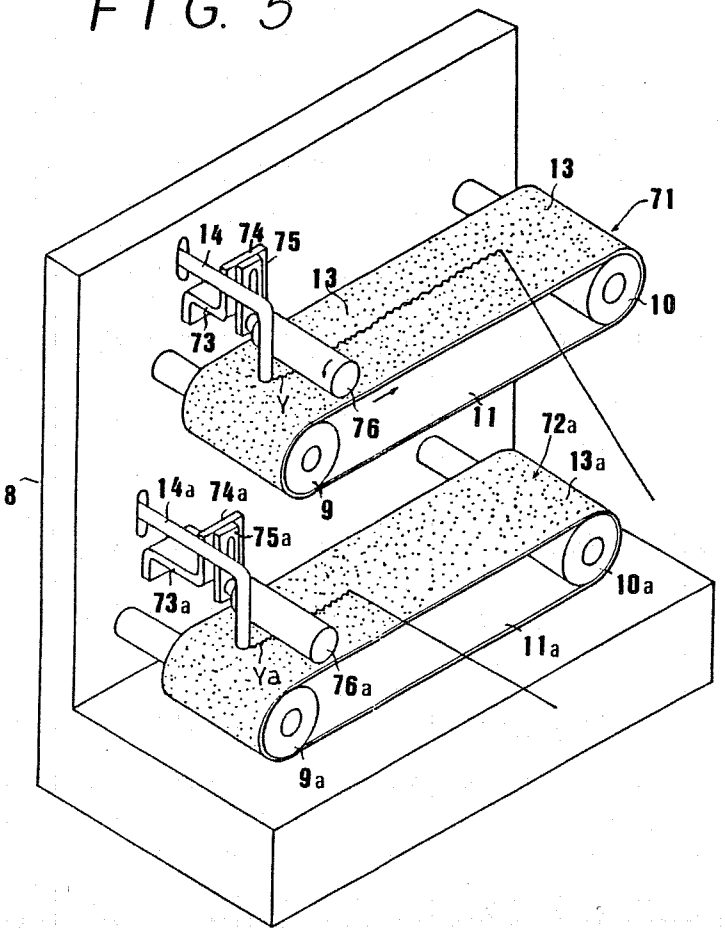
FIG. 5 is a perspective view of an embodiment of the present invention.

In the embodiment illustrated in FIG. 5, a roller is pressed against the weft yarn retaining surface and serves as a means for blacking ejected fluid.

On the front surface of a support frame 8, a first weft yarn storing device 71 and a second weft yarn storing device 72 are vertically superposed. Since the first weft yarn storing device 71 and the second weft yarn storing device 72 have the same construction except that they are horizontally, i.e., parallel to and perpendicular to the support frame, displaced so as to enhance operability upon occurrence of yarn breakage, only the first weft yarn storing device 71 will now be explained, and the parts of the second weft yarn storing device 72 are designated by the reference numerals, which are used to designate the corresponding parts of the first weft yarn storing device, together with a subscript "a", and further explanation of the second weft yarn storing device 72 is omitted here.

Similar to the above-explained embodiments, a drive roller 9 and a driven roller 10 are driven by a drive mechanism (not shown) and are spaced a certain distance from each other on the upper front surface of the support frame 8. An endless belt 11 is wrapped around the drive roller 9 and the driven roller 10 and has moquette 12 disposed on the roller surface thereof to form a weft yarn retaining surface 13. The drive roller 9 is driven in a clockwise direction in FIG. 5, and the upper side of the endless belt 11 is moved in a direction designated by an arrow in FIG. 5.

A feed nozzle 14 perpendicularly extends from the support frame 8 at a position above the drive roller 9 and its position is vertically adjustable. The front end of the feed nozzle 14 is bent downwardly so that it is directed toward the weft yarn retaining surface 13 above the drive roller 9. A weft yarn Y fed from the measuring roller mechanism (not shown) is introduced into the feed nozzle 14 and is continuously ejected thereby towards the weft yarn retaining surface 13.

A support bracket 73 is secured to the front surface of the support frame 8 at the side of the feed nozzle 14 near the drive roller 9, and its front portion 74 has a support plate 75 secured thereto adjustably in horizontal and vertical directions. The support plate 75 has a press roller 76 rotatably mounted thereon, and the lower outer surface of which is pressed to the moquette 12 forming the weft yarn retaining surface 13. The press roller 76 is rotated in a direction designated by an arrow as the weft yarn retaining surface 13 is moved in a direction designated by an arrow.

Figure 6:
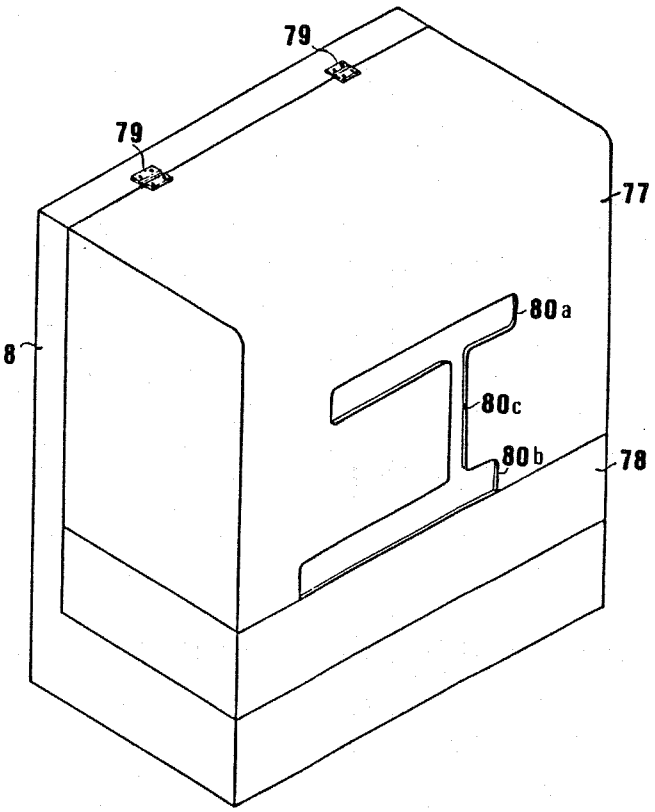
FIG. 6 is a perspective view of a cover.

The first and second yarn storing devices 71 and 72 are surrounded by a cover 77 and a guard 78 illustrated in FIG. 6 in order to avoid depositing of flies on the stored weft yarn Y. The cover 77 is pivoted on the frame 8 by means of hinges 79. The cover 77 has upper and lower withdrawal openings 80*a* and 80*b* horizontally formed on the front surface thereof. During normal operation, the weft yarn Y stored in the first weft yarn storing device 71 is withdrawn through the upper withdrawal opening 80*a*, and the weft yarn Y stored in the second weft yarn storing device 72 is withdrawn through the lower withdrawal opening 80*b*, and they are introduced to the respective main nozzles (not shown).

The guard 78 is secured to the frame 8, and its height is set in such a manner that a part of the upper edge forms a lower edge of the lower withdrawal opening 80*b* and that the guard forms the lower portion of the cover 77. A vertical slit 80*c* is formed between the upper withdrawal opening 80*a* and lower withdrawal opening 80*b* so that the weft yarn, which has been stored in the first weft yarn storing device 71 and which has been withdrawn through the upper withdrawal opening 80*a*, can escape through the vertical slit 80*c*, when the cover 77 is open upon yarn breakage.

The weft yarn Y is ejected from the feed nozzle 14 at a predetermined speed against the weft yarn retaining surface 13 located above the drive roller 9 and is deposited in a coil-like shape and attached to the weft yarn retaining surface 13. The weft yarn Y thus attached to the weft yarn retaining surface 13 is moved below the press roller 76 as the weft yarn retaining surface 13 moves. At this time, the weft yarn Y is so pressed against the weft yarn retaining surface 13 that it enters between the tufts of the moquette 12 by the pressing action between the lower surface of the press roller 76 and the moquette 12. As a result, the weft yarn Y is more evenly and securely attached to the weft yarn retaining surface 13 as compared with the attachment by only the ejecting force from the feed nozzle 14.

The weft yarn Y, which has been forcedly attached to the weft yarn retaining surface 13, is conveyed toward the driven roller 10 as the endless belt 11 moves, and it is stored on the weft yarn retaining surface 13 until it starts to be inserted.

As described above, since the weft yarn Y can be evenly attached to the moquette 12 by means of the pressing action of the press roller 76 to the moquette 12, the stored weft yarn Y is successively withdrawn in good order upon ejection of the main nozzles (not shown). Accordingly, there is no danger that turns of the stored weft yarn Y are thrown together, and faulty picking can be prevented from occurring. Further, because the roller 76 is disposed near the feed nozzle 14, the stored weft yarn Y is prevented from being disordered by air flow ejected from the feed nozzle 9.

Further, if the locational arrangement of the press roller 76 is appropriately adjusted in a vertical direction, the pressing condition can be set at an optimal condition in accordance with the kind and count of the weft yarn.

In the above-described embodiment, the present invention is carried out in a device for mixing use, which device is provided with the first weft yarn storing device 71 and the second weft yarn storing device 72. However, the present invention may be naturally applied to a device for a single weft yarn, which device is provided with only the first weft yarn storing device 71. Examples of such a device are illustrated in FIGS. 7 and 8.

In the embodiment illustrated in FIG. 7, the drive roller 9 and the press roller 76*b* are operably connected to each other by means of a crossed belt 81 so as to positively rotate both the rollers in opposite directions. According to this construction, the peripheral length of the rotated press roller 76*b* can be always the same as the moved distance of the weft yarn retaining surface 13 without causing any slip therebetween. Accordingly, the weft yarn Y can be evenly pressed by blocking means in the form of roller 76*b* without being twisted on the weft yarn retaining surface 13.

In the embodiment illustrated in FIG. 8, the ends of the blocking means formed by press roller 76*c* are rotatably supported by the support arms 82, and the base portions of the arms 82 are pivoted on support mountings 83 and are connected to springs 84 so that the press roller 76*c* always resiliently presses the weft yarn retaining surface 13. According to this construction, the force for pressing the weft yarn Y can be adjusted as desired by adjusting the urging force of the springs 84.

The present construction of the present invention may be applied to a weft yarn storing device wherein a disc is used in place of a belt as a weft yarn retaining surface.

Please note that the surface material of the press roller 76*c* is not limited as long as it does not cause any fluffs in the weft yarn Y during the pressing of the weft yarn against the retaining surface. For example, metallic material, rubber, glass, ceramics, carbon, or bakelite may be used for a press roller in accordance with the material of the weft yarn Y.

Further, the feed nozzle was perpendicularly bent in the above-described embodiments, however, the bent angle may be altered as desired.

In FIG. 9, a forked support bracket 85 is hung down from the upper inside of a cover 77, and a roller 76*d* is rotatably supported between the forked pieces of the bracket 85 to also serve as a blocking means. The roller 76*d* is slightly pressed against the weft yarn retaining surface 13 when the container is closed. Accordingly, the weft yarn ejected from a feed nozzle 14 and deposited on the weft yarn retaining surface 13 is forcedly attached to the weft yarn retaining surface 13 by means of the roller 76*d* as the weft yarn retaining surface 13 is moved. Accordingly, the weft yarn Y is evenly attached to the weft yarn retaining surface 13.

When the container is open, the roller 76*d* is lifted together with the cover 77 and is spaced from the weft yarn retaining surface 13, thus the adjustment of the weft storing condition can be readily performed.

As described above, the adverse effect of the fluid ejected from the feed nozzle 14 to the stored weft yarn Y is avoided by means of the press roller, and therefore, there is no danger such as the adverse affection of the ejected fluid on the stored weft yarn, even when the moving speed of the belt 11 is decreased. Further, while a weft yarn ejected from a feed nozzle is deposited onto a weft yarn retaining surface, the deposited weft yarn is led to a portion between the weft yarn retaining surface and the press roller as the weft yarn retaining surface moves. At this time, the stored weft yarn is subjected to pressing between the roller and the weft yarn retaining surface, and the weft yarn is surely retained by weft yarn retaining surface. The weft yarn is moved from the pressed position and is stored on the retaining surface until just before the commencement of the weft yarn insertion.

Accordingly, the withdrawal resistance during the weft yarn inserting operation depends on only the attaching conditions between the stored weft yarn and the weft yarn retaining surface. Further, the stored weft yarn is appropriately retained by the weft yarn retaining surface.

Other embodiments will now be explained, wherein the weft yarn retaining surface is covered by a container and a weft yarn withdrawal resistance applying means is disposed on the container.

Figure 10:
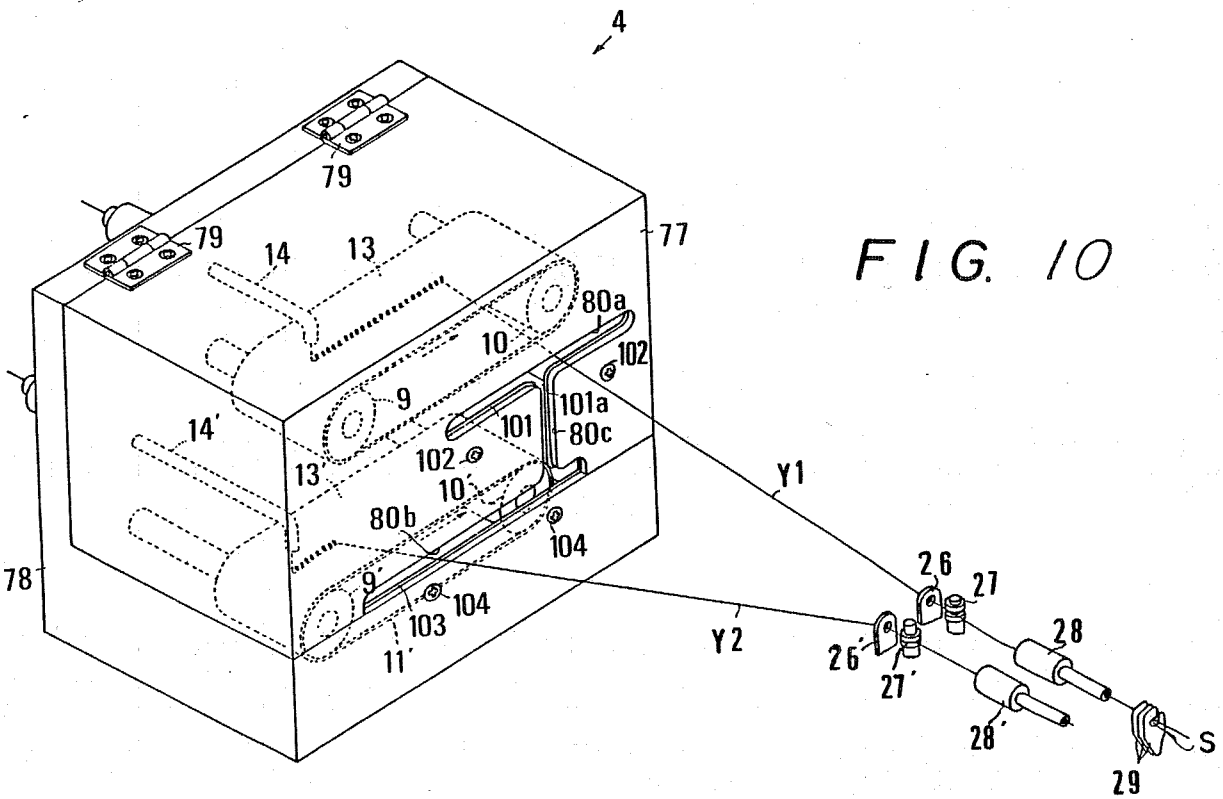
FIG. 10 is a perspective view of an embodiment of the present invention, wherein the container is closed.

In FIG. 10, weft yarns Y1 and Y2 are supplied from a pair of cheeses (not shown) and are introduced into a weft yarn storing device 4 via a measuring mechanism (not shown).

The weft yarn storing device will now be explained in detail a container body 78 is fixed on a side frame of a weaving loom. A pair of drive rollers 8 and 9' are driven by a drive mechanism (not shown). A pair of driven rollers 10 and 10' are correspondingly disposed to the drive rollers 9 and 9'. Endless belts 11 and 11' are wrapped around the rollers 9 and 10, and the rollers 9' and 10', respectively. The belts 11 and 11' have moquette 12 disposed on the outer surfaces thereof to form weft yarn retaining surfaces 13 and 13'. The drive rollers 9 and 9' are driven in a clockwise direction in FIG. 10, and the endless belts 11 and 11' are moved in a direction desiganted by a dot arrow in FIG. 10. The lower belt 11' is displaced forwardly and to the left relative to the upper belt 11.

A feed nozzle 14 perpendicularly extends from the container body 78 at a position above the drive roller 9 and the front end of the feed nozzle 14 is bent downwardly so that it is directed to the weft yarn retaining surface 13 on the drive roller 9. A weft yarn Y1 is fed from the measuring mechanism and is introduced into the feed nozzle 14, from where it is continuously ejected towards the weft yarn retaining surface 13.

Similarly, a feed nozzle 14' perpendicularly extends from the container body 78 at a position above the drive roller 10' and the front end of the feed nozzle 14' is bent downwardly so that it is directed to the waft yarn retaining surface 13' on the drive roller 10'. A weft yarn Y2 fed from the measuring mechanism is introduced into the feed nozzle 14' and is continuously ejected thereby towards the weft yarn retaining surface 13'. The weft yarns Y1 and Y2 ejected onto the weft yarn retaining surfaces 13 and 13' are deposited on the weft yarn retaining surfaces forming a coil-like shape as the movement of the belt 11 and 11' progresses.

A cover 77 is pivoted on the front surface of the container body 78 by means of hinges 79 so as to be vertically privotal and the front portion of the container body can be open. More specifically, a container is constructed with the container body 78 and the cover 77, which is capable of being open, and contains the feed nozzles 14 and 14' and the weft yarn retaining surfaces 13 and 13'. The cover 77 has a horizontally elongated opening **80*a* at a position facing the weft yarn retaining surface 13 when it is closed, and also has a groove 80*b* in parallel with the opening 80*a* at a lower front edge, i.e., free end, of the cover 77 facing the weft yarn retaining surfce 13', and the opening 80*a* and the groove 80*b* are communicated with each other by a slit 80*c*. In other words, the opening 80*a* is communicated with the outside through the slit 80*c* and the groove 80*b*. When the cover 77 is closed, the opening 80*a*, the slit 80*c* and the groove 80*b* form a closed yarn threading hole, and the weft yarn Y1 fed from the feed nozzle 14 is withdrawn through the opening 80*a*, and the weft yarn Y2 fed from the feed nozzle 14' is withdrawn through the groove 80*b* (which will be referred to as "opening 80*b***" hereinafter).

A weft yarn guide plate 101, which has a guide hole **101*a* having a similar shape as that of the openings 80*a* and 80*b* and slit 80*c* and a width slightly smaller than that of the openings 80*a* and 80*b* and slit 80*c*, is secured to the inside of the front wall of the cover 77 by screws 102 and nuts (not shown), so that the guide hole 101*a* is aligned with the holes 80*a* amd 80*b* and the slit 80*c*. Similarly, a guide plate 103 formed in an elongated plate is secured to the inside of the front wall of the container body 78 by means of screws 104 and nuts (not shown). The upper surface of the guide plate 103 slightly projects from the upper edge of the front wall, and thus closed guide hole 101*a* is formed together with the guide plate 101**.

In front of the weft yarn storing device, there is disposed a first weft yarn inserting device comprising a yarn guide 26, a gripper 27, and there is also a second weft yarn inserting device disposed in parallel with the first weft inserting device comprising a yarn guide 26', a gripper 27' and a weft yarn inserting main nozzle 28'. The weft yarns Y1 and Y2 withdrawn through the weft yarn withdrawal openings **80*a* and 80*b* are introduced into the weft yarn inserting main nozzles 28 and 28', which are alternatively located at a weft inserting position on the basis of the predetermined weft inserting pattern, and the weft yarns Y1 and Y2 are inserted into the weft yarn guide passages S, which are formed by a plurality of weft guides 29 disposed on a slay (not shown), from the main nozzles 28 and 28'** in accordance with the weft inserting pattern.

In this embodiment, the weft yarns Y1 and Y2, withdrawn from the weft yarn withdrawal openings **80*a* and 80*b*, are slightly upwardly withdrawn, and accordingly, the weft yarn Y1 contacts the upper edge of the guide hole 101*a* corresponding to the weft withdrawal opening 80*a*, and the weft yarn Y2 contacts the upper edge of the guide hole 101*a* corresponding to the weft withdrawal opening 80*b* on the left of the slit 80*c*, while they are withdrawn. Therefore, the withdrawal resistance can be adjusted at a desired level, when an appropriate material is selected for the guide plate 101**.

During normal operation of the weaving loom, the container is closed. The weft yarn Y1, which has been stored on the weft yarn retaining surface 13, is withdrawn while it is traversed to and fro along the weft yarn withdrawal opening **80*a*. Similarly, the weft yarn Y2, which has been stored on the weft yarn retaining surface 13', is withdrawn while it is traversed to and fro along the weft yarn withdrawal opening 80*b*, which is located on the left of the slit 80*c*. Under such a condition, invasion of floating flies are allowed only through the withdrawal openings 80*a* and 80*b* and the slit 80*c*. However, at the same time, air is always ejected within the container from the feed nozzles 14 and 14' and leaks through the withdrawal openings 80*a* and 80*b* and the slit 80*c***. Accordingly, the invastion of floating flies into the container is substantially prevented from occurring.

As a result, deposition of floating flies on the weft yarn retaining surfaces 13 and 13' is prevented, and there is no danger that the weft yarns Y1 and Y2 introduced into the weft yarn inserting main nozzles 28 and 28' are contaminated with floating flies. As a result, clogging by flies in the main nozzles 28 and 28', which may cause a faulty picking, is prevented, and defects in woven fabric, which may caused by such flies, is prevented from occurring.

Figure 11:
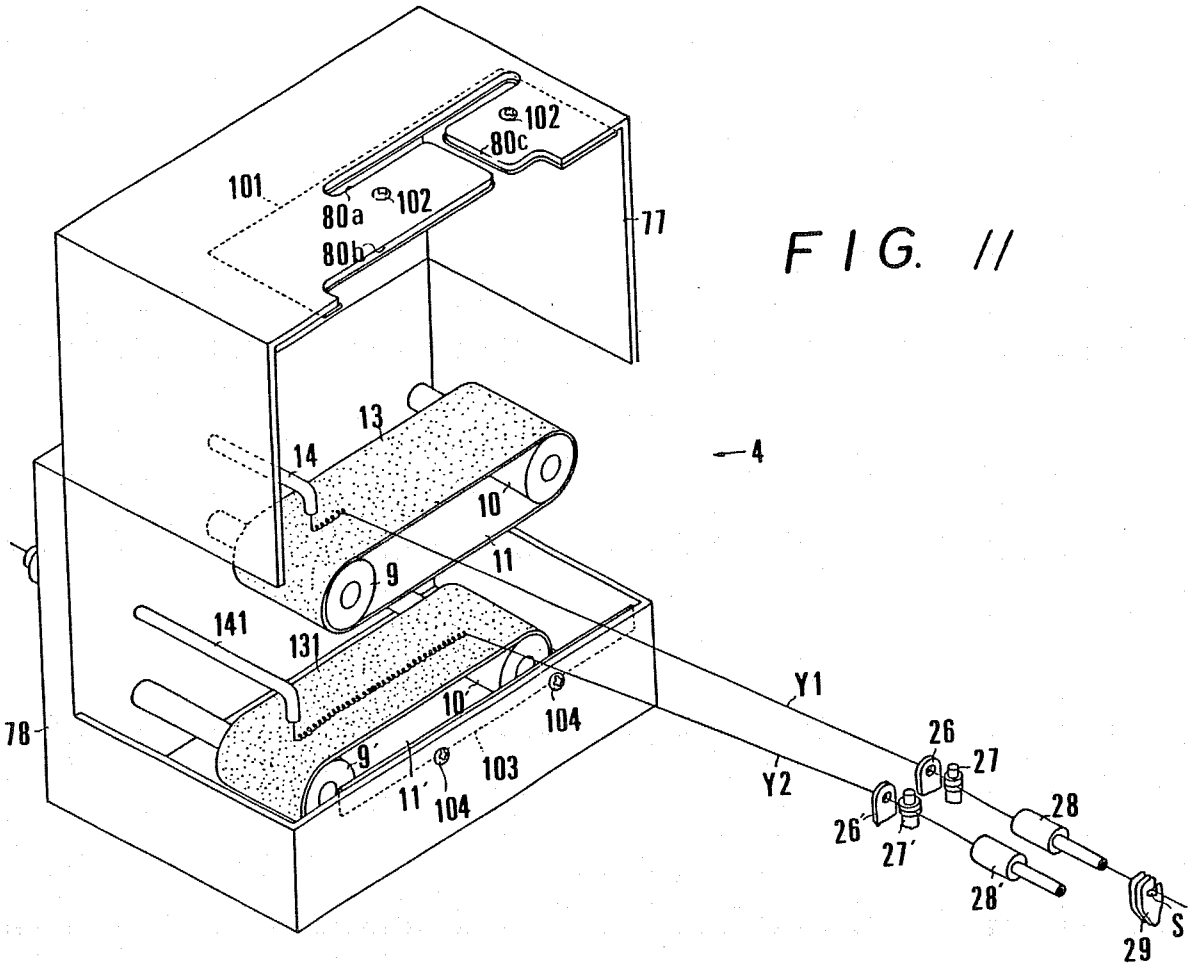
FIG. 11 is a perspective view, wherein the container is open.

When a faulty picking or weft yarn breakage occurs, in order to prepare for re-starting the weaving loom, the weft yarn storing conditions on the weft yarn retaining surfaces 13 and 13' are adjusted by opening the cover 77 so as to expose the inside of the container as illustrated in FIG. 11. At this time, the weft yarn Y1, which has been passed through the withdrawal opening 80*a*, can be taken out through the slit 80*c* and the withdrawal opening 80*b*, and thus, the adjusting operation can be immediately started under the condition wherein the container is open. Accordingly, operability is very high. The operability is also high with regard to the repair of the weft yarn Y2.

When the container, which has been open, is closed, threading operation of the weft yarns Y1 and Y2 into the withdrawal openings 80*a* and 80*b* can be readily performed, and troublesome threading operation, wherein an end of the weft yarn is pierced into the withdrawal opening 80*a* or 80*b*, can be omitted.

Figure 12:
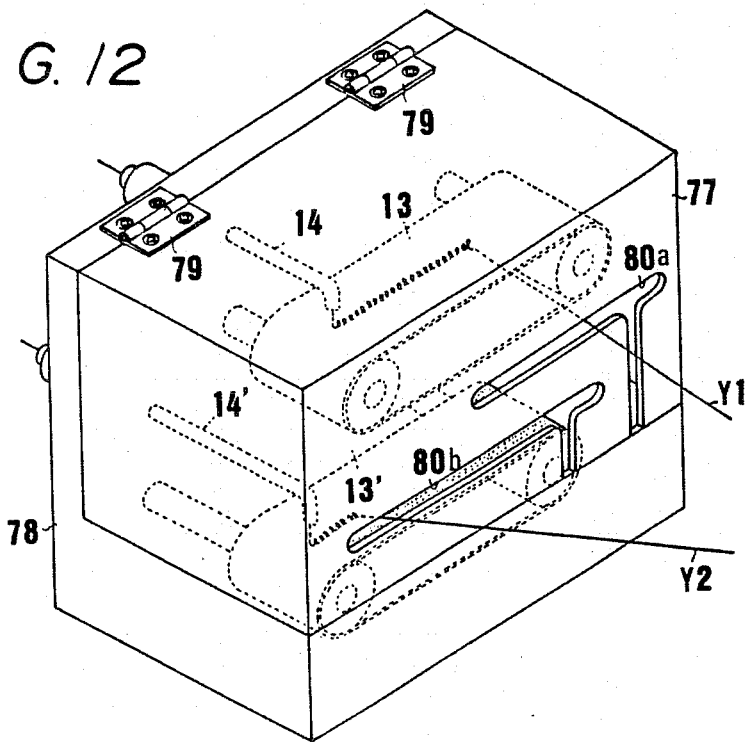
FIGS. 12 through 15 are perspective views of other embodiments of the present invention.
Figure 13:
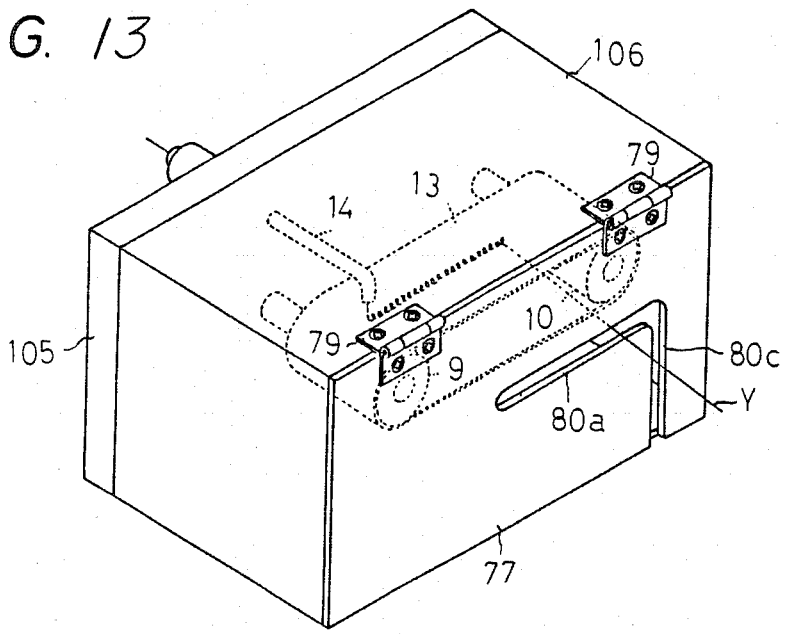
Figure 14:
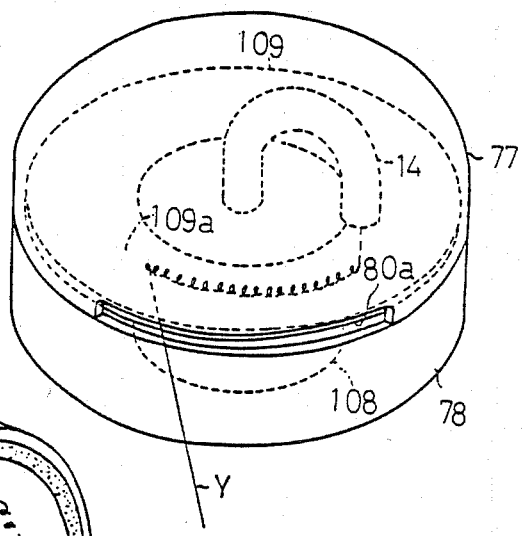
Figure 15:
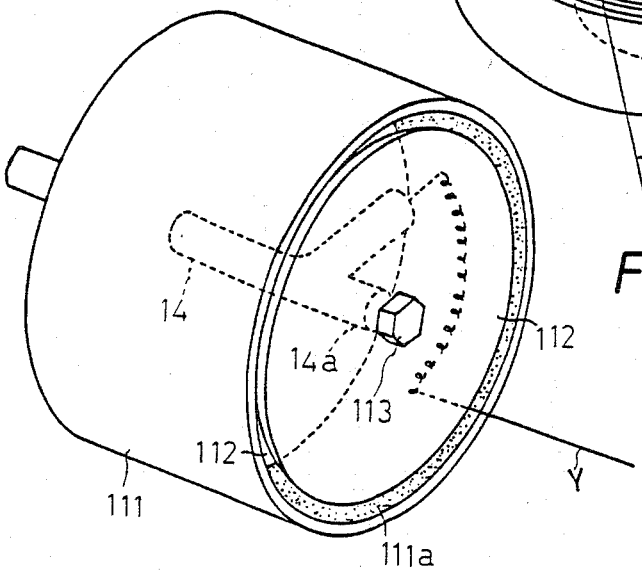

The present invention is not limited to the above-explained embodiment and can be carried out in other embodiments, for example, those illustrated in FIGS. 12 through 14.

In the embodiments illustrated in FIG. 12, like the above described embodiment, a pair of weft yarn retaining surfaces 13 and 13' are vertically spaced relative to each other. In FIG. 12, weft yarn withdrawal openings 80*a* and 80*b* formed on the front wall of cover 77 corresponding to the weft yarn retaining surfaces 13 and 13' independently communicate with the outside. Accordingly, entanglement of weft yarns Y1 and Y2 is prevented from occurring when the cover 77 is pivoted to open the container.

In FIG. 13 a side frame 106 is formed in a square box shape and is secured to the front wall of a support frame 105. The frame 105 has a feed nozzle 14 and drive and driven rollers 9 and 10 mounted thereon. A cover 77 is pivoted to the front portion of the side frame 106 by a hinge 79. The lower edge of the cover can be attached to the side frame 106 by means of, for example, a magnet. The cover 77 has an elongated weft yarn withdrawal opening 80*a* horizontally formed therein, which is communicated with the outside via a slit 80*c* perpendicularly connected thereto.

In the embodiment illustrated in FIG. 14 the front end of a feed nozzle 14 upwardly penetrates a stationary table 108 and is then bent downwardly to a position near the upper surface of a disc 109. The disc 109 is rotated by a drive mechanism (not shown). An annular circular weft yarn retaining surface 109*a* is formed on the disc 109, and the front end of the feed nozzle 14 is directed to the weft yarn retaining surface 109*a*. Further, a container body 78 is connected to the stationary table 108, and a hemispherical cover 77 is detachably engaged with the container body. A weft yarn withdrawal opening 80*a* is formed at the connecting portion of the cover 77 and the container body 78. More specifically, the weft yarn Y is ejected from the feed nozzle 14 and is deposited on the rotating weft yarn retaining surface 109*a* at a position corresponding to the weft yarn withdrawal opening 80*a*, and it is withdrawn through the opening 80*a* upon the weft yarn insertion.

Figure 16:
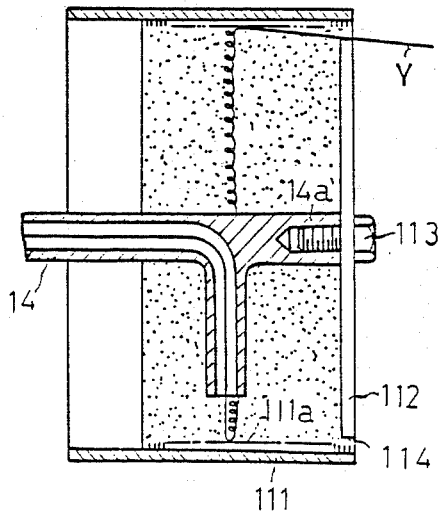
FIG. 16 is a cross sectional side view of the FIG. 15 embodiment.

In the embodiment illustrated in FIGS. 29 and 16, a weft yarn retaining surface 111*a* is formed on the inner surface of a rotary cylinder 111, a weft yarn Y is ejected to the weft yarn retaining surface 111*a* from a feed nozzle 14 disposed at the center of the cylinder 111. A circular disc 112 is secured by a screw 113 to a support arm 14*a* extending along the axis of the cylinder 111 from the bent portion of the feed nozzle 14, and a circular gap 114 serving as a weft yarn withdrawal opening is formed between the periphery of the disc 112 and the cylinder 111.

Assembling and detaching operation will be easy if the disc 112 is engaged onto the arm 14*a* so that the front end of the arm 14*a* projects from the disc 112 and a snap ring or the like is inserted onto the projecting end of the arm 14*a*.

Due to the above-described construction, the invasion of floating flies into the container is only possible through the withdrawal opening. Incidentally, air is always ejected from the feed nozzle in the container and leaks through the withdrawal opening, and accordingly, invasion of floating flies through the withdrawal opening is substantially prevented from occurring, and thus, deposition of floating flies on the weft yarn retaining surface within the container is effectively prevented.

When a weft yarn breakage or a faulty picking occurs, the cover is open to adjust the weft yarn storing condition on the weft yarn retaining surface to a suitable condition for re-starting the weaving loom. In this case, the weft yarn, which has been withdrawn from the container, can be taken out through the weft yarn withdrawal opening, which is communicated with the outside, without causing breakage of the weft yarn. Similarly, when the cover is closed, the weft yarn can be easily threaded into the weft yarn withdrawal opening. Thus, the device of the present invention has a high operability.

The present invention is not limited to the above-described embodiment and can be applied to other embodiments, for example, those illustrated in FIGS. 17 through 27.

Figure 17:
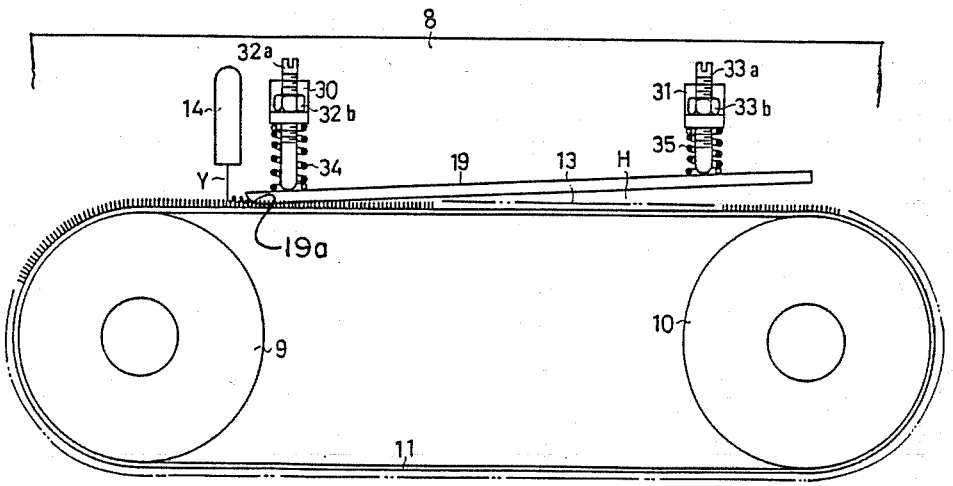
FIGS. 17, 18, and 19 are elevation views of the essential parts of other embodiments.

In the embodiment illustrated in FIG. 17, a pair of brackets 30 and 31 are fixed at the right and left portions of the front surface of the support frame 8 and have adjust screws 32*a* and 33*a* extending vertically, respectively. The brackets 30 and 31 and the cover member 19 are connected to each other by means of tension springs 34 and 35, which are inserted onto the screws 32*a* and 33*a*, respectively. Set screws 32*b* and 33*b* are meshing with the screws 32*a* and 33*a*, respectively. Accordingly, the pressing condition of cover member 19 to the moquette 12 and the inclination of cover member 19 can be set as desired by adjusting the meshing lengths of the screws 32 and 33. Further, when the weft yarn is withdrawn while it is in contact with the front edge 19*a* of the cover member 19, the withdrawal is damped by the action of the springs.

Figure 18:
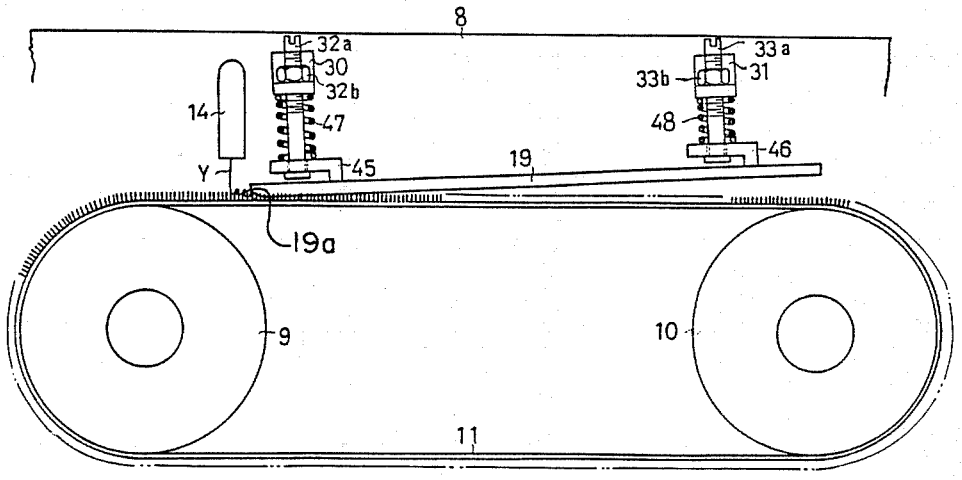

In the embodiment illustrated in FIG. 18, similar to the embodiment illustrated in FIG. 17, adjust screws 32*a* and 33*a* are engaging with a pair of brackets 30 and 31, which are fixed at the right and left portions of the front surface of the support frame 8, and have nuts 32*b* and 33*b* meshing therewith. The heads of the screws 32*a* and 33*a* located at the lower ends thereof are engaging with brackets 45 and 46, which are fixed to the upper surface of the cover member 19. Compression springs 47 and 48 are inserted between the brackets 32*a* and 33*a* and the brackets 45 and 46, respectively. Accordingly, the pressing condition of cover member 19 to the moquette 12 and the inclination of cover member 19 can be set as desired by adjusting the lengths of the screws 32*a* and 33*a*. Further, the withdrawal of the stored weft yarn is damped.

Figure 19:
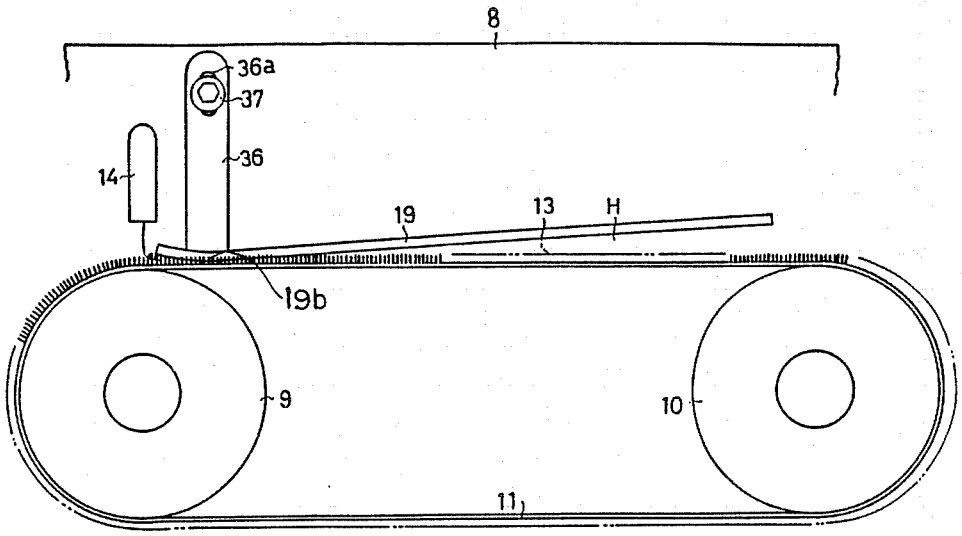

In the embodiment illustrated in FIG. 19, the cover member 19 has a weft yarn entrance 19*b* formed in an arc for introducing weft yarn and an upwardly projecting bracket 36 secured to the other end of the arc. The bracket 36 has a vertically elongated hole 36*a* around a position corresponding to the center of the arc and is adjustably secured to the support frame 8 by means of a screw 37 inserted into the elongated hole 36. Accordingly, the inclination of the cover member 19 can be adjusted by pivoting it about the screw 37, and its pressing condition to the moquette 12 can be adjusted by sliding it along the elongated hole 36*a*.

FIGS. 20 through 25 illustrate various alternatives of the cover member 19.

Figure 20:
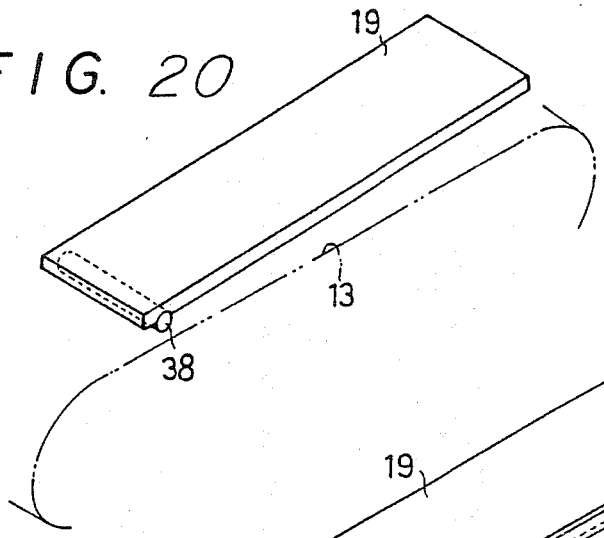

In FIG. 20, the cover member 19 is made of a transparent synthetic resin and has a transverse bar 38 at the lower surface of the weft yarn entrance thereof, which bar is made of a durable material, such as ceramics, piano wire having chromium plating on the surface thereof. Accordingly, the cover member 19 of this embodiment has advantages that the abrasion of the cover member 19 is prevented from occurring and that the weft yarn storing condition can be readily observed.

Figure 21:
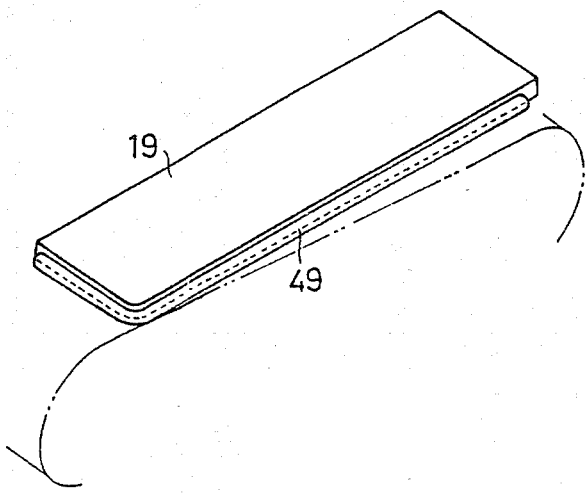

In FIG. 21, a bar 49 similar to the above-described bar is also disposed at the front end of the cover member 19 so that the abrasion of the cover member 19 is prevented from occurring while the stored weft yarn is withdrawn.

The cover member 19 illustrated in FIG. 22 is formed in a convex shape except for the weft yarn entrance. Its portion, which contacts the moquette 12, is hard chromium plated.

Contrary to this, in FIG. 23, the cover member 19 is formed in concave shape.

In the cover member 19 illustrated in FIG. 24, the portion except for the entrance is inclined and twisted relative to the weft yarn entrance.

In the cover member 19 illustrated in FIG. 25, the front corner edge of the weft yarn entrance is bent upwardly, so that the weft yarn, which is fed from the feed nozzle 14, does not contact the cover member 19 during the inserting operation upon the completion of the withdrawal of the stored weft yarn, so that the resistance of withdrawal of the stored weft yarn is smoothly continued to the resistance of withdrawal under restrained condition, and so that the decrease of the weft inserting speed is more relieved.

In the embodiment illustrated in FIG. 26, a disc 40 is rotated in a direction designated by an arrow around a stationary shaft 39 and has the moquette 12 formed in a annular shape and disposed thereon to form a weft yarn retaining surface 13. The shaft 39 has a support ring 41 rotatably and vertically slidably engaging therewith, and the ring 41 is adjustably secured to the shaft 39 by means of a screw 42. A cylindrical arm 41*a* horizontally extends from the side surface of the ring 41 and is located at the side of the feed nozzle in the direction of the rotation of the disc 40. The arm 41*a* has the cover member 19 turnably fitted at the lower side thereof by inserting the cover member 19 into the notch portion of the ring 41, and the cover member 19 is secured by a screw 43. The cover member 19 is formed from a fan shaped plate by bending the inserting end at a right angle, and the bent portion is used as a weft yarn entrance and the other end is gradually away from the weft yarn retaining surface 13. According to this embodiment, advantages similar to those achieved by the above-described embodiments can be achieved.

In the embodiment illustrated in FIG. 27, a weft yarn retaining surface 13 is formed on the inner surface of a rotating cylinder 44, and a weft yarn Y is ejected onto the weft yarn retaining surface 13 from a feed nozzle 14, which is disposed inside the cylinder 44. The feed nozzle 14 has a cover member 19 secured thereto and formed in an arc. It is, of course, possible to adjustably arrange the location of the cover member 19.

Although in this embodiment, the cylinder 44 is rotated, the feed nozzle 14 and the cover member 19 may be rotated about the axis of the cylinder in place of the cylinder 44. Alternatively, the weft yarn retaining surface 13 may be formed on the outer surface of the cylinder 44.

A weft yarn ejected from a feed nozzle is deposited onto a weft yarn retaining surface, which moves relative to the feed nozzle, to form a coil-like shape. The deposited weft yarn is led to a portion between the weft yarn retaining surface and the cover member as the weft yarn retaining surface moves. At this time, the stored weft yarn is subjected to pressing between the one end of the cover member and the weft yarn retaining surface, and the weft yarn is surely retained by the weft yarn retaining surface. The weft yarn, which has been retained by the surface in a foregoing manner, is stored below the cover member just before the commencement of the weft yarn insertion, and it is withdrawn as soon as the weft yarn insertion is commenced. The gap between the cover member and the weft yarn retaining surface is so selected that the gap increases as a position moves away from the weft yarn feed nozzle along the weft yarn retaining surface, and that the weft yarn, located at the side where it starts to be withdrawn, is not pressed to the waft yarn retaining surface by means of the cover member. Accordingly, the withdrawal resistance upon the commencement of the withdrawal of the stored weft yarn depends on only the attaching conditions between the stored weft yarn and the weft yarn retaining surface. The stored weft yarn is subjected to pressing by the weft yarn introducing end of the cover member and is appropriately attached to the weft yarn retaining surface. Accordingly, throwing of turns of the weft yarn is prevented from occurring.

As the stored weft yarn located near the weft yarn introducing end of the cover member is withdrawn, the withdrawn weft yarn is subjected to pressing by the cover member, and the withdrawal resistance increases. The increase of the withdrawal resistance continues until the completion of the withdrawal. As soon as the withdrawal of the stored weft yarn is completed, the weft insertion takes place while the feeding speed is kept at a constant speed by means of the feed nozzle. Accordingly, sudden decrease of the waft yarn inserting speed is relieved upon the transfer from the withdrawal of the stored weft yarn to the weft yarn insertion under the control of the feed nozzle, and thus, faulty picking is prevented from occurring.

As described above, the weft yarn storing device of the present invention achieves unexpected advantages that it can appropriately store the weft yarn on the weft yarn retaining surface and that it can prevent a weft yarn breakage or a faulty picking from occurring.

What is claimed is:

1. A device for storing a weft yarn for inserting in a jet loom comprising a surface which moves in one direction and retains a weft yarn thereon between a yarn-receiving position and a yarn withdrawal-start position spaced away from said yarn-receiving position in said one direction, and a feed nozzle which ejects said weft yarn together with fluid onto said weft yarn retaining surface at said yarn-receiving position, said fluid ejected from said feed nozzle impinging upon said weft yarn retaining surface at an impingement point, characterized in that a narrow blocking means extending transversely of said direction of surface movement for blocking said ejected fluid from the area of said surface downstream of said point engages said surface at a position slightly displaced from said impingement point and for a short distance therebeyond on the side thereof towards said start position where a weft yarn withdrawal operation is started, said narrow blocking means permitting said yarn, ejected on to the latter, to pass thereunder, said yarn when retained on said surface between said narrow blocking means and said withdrawal-start position being free of pressure against said moving surface.

2. A device for storing a weft yarn for inserting in a jet loom according to claim 1, wherein said blocking means comprises a roller extending transverse to said moving direction of said weft yarn retaining surface, and said roller is pressed substantially against said weft yarn retaining surface.

3. A device for storing a weft yarn for inserting in a jet loom according to claim 1, wherein said weft yarn retaining surface and said blocking means are substantially contained in a container comprising a container body and a cover pivoted on said container body, at least one of said cover and said container body having a withdrawal opening formed therein for guiding said weft yarn withdrawn from said weft yarn retaining surface, said withdrawal opening being open at a free end of said cover.

4. A device for storing a weft yarn for inserting in a jet loom according to claim 1, wherein said blocking means comprises a plate extending over said weft yarn retaining surface and having an end extending transversely across, and substantially engaging said weft yarn retaining surface at a position adjacent to said feed nozzle, said plate being inclined upwardly from its said surface-engaging end, and increasingly spaced away from said surface along the length of said plate extending in the direction towards said yarn withdrawal-start position.

5. A device for storing a weft yarn for inserting in a jet loom according to claim 1, wherein said yarn is withdrawn towards one side of said surface at said yarn withdrawal-start position, and further characterized in that a narrow, elongated yarn withdrawal resistance applying means, extending in said direction of surface movement on said one side of said surface and spaced laterally away from a yarn retaining zone thereon for engaging said weft yarn during at least a part of a weft withdrawing operation, is disposed at least immediately adjacent to said moving surface to permit said yarn being withdrawn to pass thereunder at said yarn withdrawal-start position.

6. A device for storing a weft yarn for inserting in a jet loom according to claim 1, wherein said moving surface is in the form of a disc which is rotatable in said one direction.

7. A device for storing a weft yarn for inserting in a jet loom according to claim 1, wherein said moving surface is a peripheral surface of a cylinder which is rotatable in said one direction.

8. A device for storing a weft yarn for inserting in a jet loom comprising a surface which moves in one direction and retains a weft yarn thereon between a yarn-receiving position and a yarn withdrawal-start position, at which said yarn is withdrawn upwardly and angularly towards one side of and off from said surface, and a feed nozzle which ejects said weft yarn onto said weft yarn retaining surface at said yarn-receiving position, fluid ejected from said feed nozzle impinging upon said weft yarn retaining surface at an impingement point, characterized in that a narrow, elongated yarn withdrawal resistance applying means, extending in said direction of surface movement on said one side of said surface and spaced laterally away towards said one side from a yarn retaining zone thereon for engaging said weft yarn during a weft withdrawing operation, is disposed adjacent to said moving surface to permit said yarn being withdrawn to pass thereunder in engagement therewith after its withdrawal from said surface.

9. A device for storing a weft yarn for inserting in a jet loom according to claim 8, wherein said withdrawal resistance applying means comprises a guide bar extending in said moving direction of said weft yarn retaining surface and engaging said weft yarn while said weft yarn is withdrawn.

10. A device for storing a weft yarn for inserting in a jet loom according to claim 8, wherein said weft yarn retaining surface and said resistance applying means are substantially contained in a container comprising a container body and a cover, at least one of said cover and said container body having a withdrawal opening formed therein for guiding said weft yarn withdrawn from said weft yarn retaining surface, said withdrawal resistance applying means being formed by substantially an edge of said withdrawal opening.

11. A device for storing a weft yarn for inserting in a jet loom according to claim 10, wherein said withdrawal opening is formed as an elongated hole, and said withdrawal resistance applying means comprises a guide bar extending along said elongated hole.

12. A device for storing a weft yarn for inserting in a jet loom according to claim 8, wherein said withdrawal resistance applying means comprises a cover member, one side of which constitutes said yarn withdrawal resistance applying means, and one end of which comprises a narrow edge extending transversely across, and substantially engaging said weft yarn retaining surface at a position adjacent to said feed nozzle, and a gap is formed between said weft yarn retaining surface and said cover member side, which gap increases as a yarn position on said surface moves away from said yarn-receiving position towards said yarn withdrawal-start position.

13. A device for storing a weft yarn for inserting in a jet loom according to claim 12, wherein said cover member is transparent.

14. A device for storing a weft yarn for inserting in a jet loom according to claim 12, wherein said cover is mounted at each of its ends by means providing for resilient movement towards and away from said surface, said mounting means having means for adjusting the position of said cover towards and away from said surface.

15. A device for storing weft yarn according to claim 8, wherein said surface is the interior surface of a cylinder which is rotatable about its cylindrical axis, and said elongated yarn withdrawal resistance applying means comprises the outer periphery of a disc in fixed position centered on and perpendicular to said cylindrical axis, the diameter of said disc being less than the interior diameter of said cylinder to provide peripheral spacing between said disc periphery and said surface.

* * * * *

UNITED STATES PATENT AND TRADEMARK OFFICE

CERTIFICATE OF CORRECTION

PATENT NO. : 4,784,191

DATED : November 15, 1988

INVENTOR(S) : Umemura et al

It is certified that error appears in the above-identified patent and that said Letters Patent is hereby corrected as shown below:

Column 2, line 2, after "consumption" insert comma --,--.

Column 3, line 55, change "impingement" to --impinging--

Column 8, line 13, change "and" to --an--.

Column 8, line 66, change "blacked" to --blocked--.

Column 8, line 66, change "blacking" to --blocking--.

Column 9, line 3, after "position", insert period --.-- and delete "black-".

Column 9, line 4, delete "ing."

Column 9, line 17, change "blacking" to --blocking--.

Column 9, line 30, change " blacking" to --blocking--.

Column 9, line 31, change "retraining" to --retaining--.

Column 9, line 32, change "blacking" to --blocking--.

Column 9, line 33, 34, change "black-" to --block- --.

Column 9, line 44, after has, insert --a--.

Column 9, line 44, change "blacking" to --blocking--.

Column 9, line 47, change "blacking" to --blocking--.

UNITED STATES PATENT AND TRADEMARK OFFICE

CERTIFICATE OF CORRECTION

PATENT NO. : 4,784,191

DATED : November 15, 1988

INVENTOR(S) : Umemura et al

It is certified that error appears in the above-identified patent and that said Letters Patent is hereby corrected as shown below:

Column 9, line 57, after "yarn", insert --Y--.

Column 9, line 64, change "blacking" to --blocking--.

Column 10, line 2, change "blacking" to --blocking--.

Column 10, line 12, change "blacking" to --blocking--.

Column 10, line 61, after "6", insert comma --,--.

Column 11, line 3, change "nozles" to --nozzles--.

Column 12, line 47, change "affection" to --effect--.

Column 12, line 56, after "by", insert --the--.

Column 13, line 8, after "detail" insert period --.--; change "a" to --A--.

Column 13, line 9, change "8" to --9--.

Column 13, line 54, change "suface" to --surface--.

UNITED STATES PATENT AND TRADEMARK OFFICE

CERTIFICATE OF CORRECTION

PATENT NO. : 4,784,191

DATED : November 15, 1988

INVENTOR(S) : Umemura et al

It is certified that error appears in the above-identified patent and that said Letters Patent is hereby corrected as shown below:

Column 14, line 52, change "invastion" to --invasion--.

Column 15, line 29, after "13" insert comma --,--.

Column 15, line 40, after "14" insert comma --,--.

Signed and Sealed this

Thirteenth Day of June, 1989

*Attest:*

DONALD J. QUIGG

*Attesting Officer*

*Commissioner of Patents and Trademarks*